US009853409B2

(12) United States Patent
Dierks et al.

(10) Patent No.: US 9,853,409 B2
(45) Date of Patent: Dec. 26, 2017

(54) SELF-ADJUSTING CRIMPING TOOL

(71) Applicants: Christoph Dierks, Detmold (DE); Guenther Hanning, Detmold (DE); Detlev Hetland, Detmold (DE); David Keller, Lemgo (DE)

(72) Inventors: Christoph Dierks, Detmold (DE); Guenther Hanning, Detmold (DE); Detlev Hetland, Detmold (DE); David Keller, Lemgo (DE)

(73) Assignee: Weidmüller Interface GmbH & Co. KG (DE)

( * ) Notice: Subject to any disclaimer, the term of this patent is extended or adjusted under 35 U.S.C. 154(b) by 315 days.

(21) Appl. No.: 14/677,252

(22) Filed: Apr. 2, 2015

(65) Prior Publication Data

US 2015/0288124 A1 Oct. 8, 2015

(30) Foreign Application Priority Data

Apr. 8, 2014 (DE) ..... 20 2014 101 650 U

(51) Int. Cl.
*H01R 43/042* (2006.01)
*H01R 43/048* (2006.01)

(52) U.S. Cl.
CPC ..... *H01R 43/0424* (2013.01); *H01R 43/042* (2013.01); *H01R 43/0488* (2013.01); *Y10T 29/53226* (2015.01)

(58) Field of Classification Search
CPC ..... H01R 43/0424; H01R 43/042; H01R 43/0585; H01R 43/0488; H01R 43/048; B25B 7/12; B25B 27/14; B25B 7/10; Y10T 29/53226
USPC ..... 72/383, 417, 402; 29/751
See application file for complete search history.

(56) References Cited

U.S. PATENT DOCUMENTS

| | | | | |
|---|---|---|---|---|
| 2,079,498 A | | 5/1937 | Douglas | |
| 3,059,511 A | | 10/1962 | Morris | |
| 3,199,334 A | * | 8/1965 | Holmes | H01R 43/0424 72/409.01 |
| 3,354,692 A | | 11/1967 | Morris | |

FOREIGN PATENT DOCUMENTS

| | | |
|---|---|---|
| DE | 1615 840 A | 6/1970 |
| DE | 195 07 347 C1 | 9/1996 |
| DE | 298 03 336 U1 | 9/1998 |
| DE | 100 60 165 A1 | 6/2002 |
| DE | 101 40 270 A1 | 3/2003 |

(Continued)

*Primary Examiner* — Peter DungBa Vo
*Assistant Examiner* — John S Lowe
(74) *Attorney, Agent, or Firm* — Laubscher, Spendlove & Laubscher, P.C.

(57) ABSTRACT

A self-adjusting pliers-type crimping tool includes a crimping arrangement having movable and fixed levers that are pivotally displaced from an open condition toward a fully closed condition, thereby to generate a first crimping force for crimping an electrical contact upon a bare conductor. When the levers are at an intermediate position, a predetermined compensating energy from a caged spring assembly is released and is applied to the crimping arrangement to complete the crimping process. The spring assembly may comprise a stack of spring washers, a helical spring arrangement, or a stack of resilient elastomeric blocks.

15 Claims, 11 Drawing Sheets

(56) References Cited

FOREIGN PATENT DOCUMENTS

| | | | |
|---|---|---|---|
| DE | 10 2007 005 176 | A1 | 8/2008 |
| DE | 20 2013 103070 | U1 | 10/2013 |
| EP | 0471977 | A2 | 2/1992 |

* cited by examiner

SELF-ADJUSTING CRIMPING TOOL

BACKGROUND OF THE INVENTION

Field of the Invention

A self-adjusting pliers-type crimping tool includes a crimping arrangement having movable and fixed levers that are pivotally displaced from an open condition toward a fully closed condition, thereby to generate a first crimping force for crimping an electrical contact upon a bare conductor. When the levers are at an intermediate position, a predetermined compensating energy from a caged spring assembly is released and is applied to the crimping arrangement to complete the crimping process.

Description of Related Art

German Patent No. DE 100 60 165 A1 discloses a crimping tool which is adjusted manually to each individual cross section. It is desirable to produce a crimping tool for pressing of wire end ferrules and/or twisted contacts on the ends of cables, which, with a simple mechanical design and simple manipulation, permits crimping of ends of cables over a relatively wide range of cross section. Preferably, without any additional adjustments, as wide a range as possible of cable cross sections can be processed by a single crimping tool with twisted contacts and/or wire end ferrules.

In German patent No. DE 195 07 347 C1 crimping or pressing pliers-type tools are described for wire end ferrules to be applied to ends of cables, in which a force-path-compensation device, via a spring-loaded lever integrated and attached into the handle piece, is brought into effective connection with a lever arm of the toggle lever gear, and implemented via a cross-sectional reduction situated in the middle section of the fixed handle part in the form of a constriction. In fact, the force-path-compensation device thus implemented permits processing of wire end ferrules with varied diameter; however, the type of spring design permits no optimal adaptation of spring force to the cross section to be processed.

With this background, the object of the present invention is to provide an improved crimping tool for crimping onto bare conductors twisted contacts or wire-end ferrules having various cross-sections.

SUMMARY OF THE INVENTION

Accordingly, a primary object of the invention is to provide a self-adjusting pliers-type crimping tool including a crimping arrangement having movable and fixed levers that are pivotally displaced from an open condition toward a fully closed condition, thereby to generate a first crimping force for crimping an electrical contact upon a bare conductor. When the levers are at an intermediate position, a predetermined compensating energy from a caged spring assembly is released and is applied to the crimping arrangement to complete the crimping process. The spring assembly may comprise a stack of spring washers, a helical spring arrangement, or a stack of resilient elastomeric blocks.

According to a more detailed object, the energy compensation means for applying the caged spring energy includes a compensation lever that is operable by a tie rod to rotate the holder relative to the locked cam during the second stage of the crimping operation, whereby the stored compensation energy from the spring is applied to the crimping element holder.

Thus, in a simple manner it is possible, by means of the interplay of springs from the spring assembly, with one or preferably two or more springs, to make available a high level of force and a wide path for the force-path-compensation device to be created for the crimping tool. Thus it is ensured that with the crimping tool, twisted contacts or wire end ferrules can be crimped with a cross-sectional range as large as possible.

According to an especially preferred version and further development, which is also an inventive step per se, the at least one spring assembly is configured as a spring washer assembly. Additionally, this preferably exhibits one, two or more preferably axially stacked spring washers. Spring washers are to be accommodated in compact fashion in and on the tool, especially the handles. Through the use of a spring washer assembly as the force-path-compensation device, in a simple and advantageous way, the spring parameter can be adjusted as per the circumstances, thus, via an appropriate layering of the preferably used spring washers (or other springs, if necessary) in the spring washer assembly, a progressive, linear or declining characteristic curve can be generated.

One particular advantage of the tool is that, via the spring assembly used (tuned in a linear, progressive or declining manner) the tool can be adapted considerably better to a wide bandwidth of cross sections, and thus the crimping outcome is a better one over the cross sectional range.

Alternatively, according to another further development and invention it is conceivable that a spring assembly can be configured in another way, thus as a helical spring assembly or one or more elastomer springs, preferably provided with holes, especially for stacking. In this case, preferably nonetheless the basic structure is used as it has been described above, i.e. where one or more spring washers are stacked, helical springs or elastomer springs are used, especially if penetrated by the tie rod. In this respect, in the specification of embodiment examples that follows, and in the subordinate claims, the term "spring washer" can also be replaced by helical spring or elastomer springs. Mixed forms with different types of springs like spring washers and elastomer springs can likewise be implemented.

It is conceivable that the spring washer assembly exhibits individual spring washers or groups of spring washers layered in the same direction.

However, it is especially preferred if the spring washer assembly is formed from individual spring washers or groups of spring washers layered in the same direction (preferably axially), each of which, individually or as groups, are arranged in opposite directions to each other. By this means, the spring characteristic can be adjusted with especial ease.

To accommodate the washer, helical and/or elastomer spring assemblies in the handle in compact fashion, it is advantageous if the tool exhibits at least one base plate, or multiple base plates, and at least one lever of the one handle placed thereon so as to pivot, through the operation of which the crimping die is movable on the tool head in such a way that the opening of the crimping die can be made smaller and that the washer, helical and/or elastomer spring assembly is situated on and/or in the at least one base plate.

Advantageously the washer, helical and/or elastomer spring assembly is integrated into the structure, if the one base plate or plates extend into one of the handles and if the spring assembly, especially the washer, helical and/or elastomer spring assembly is situated within the range of this handle. It is especially advantageous if the washer, helical and/or elastomer springs of the washer, helical and/or elastomer spring assembly or situated in full or in part between the two base plates and/or if the washer, helical and/or elastomer spring assembly engages with external circumferential sections of the washer, helical and/or elastomer springs into elongated windows or openings in the base plates.

To configure the spring washer assembly in a simple way, it is advantageous if the washer, helical and/or elastomer spring assembly exhibits a tie rod, which axially passes through the washer, helical and/or elastomer spring assembly and its washer, helical and/or elastomer springs.

Further, it is preferred and advantageous, if a device is provided, with which the axial path via which the washer, helical and/or elastomer springs are arrayed in rows on the tie rod, can be altered, which alters the pre-tensioning of the washer, helical and/or elastomer spring assembly.

To couple the spring assembly with the crimping die, it is advantageous if a punch holder of the crimping die is connected with a compensating lever, which, by means of deflection kinematics, can extend the washer, helical and/or elastomer spring assembly, or does extend it.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
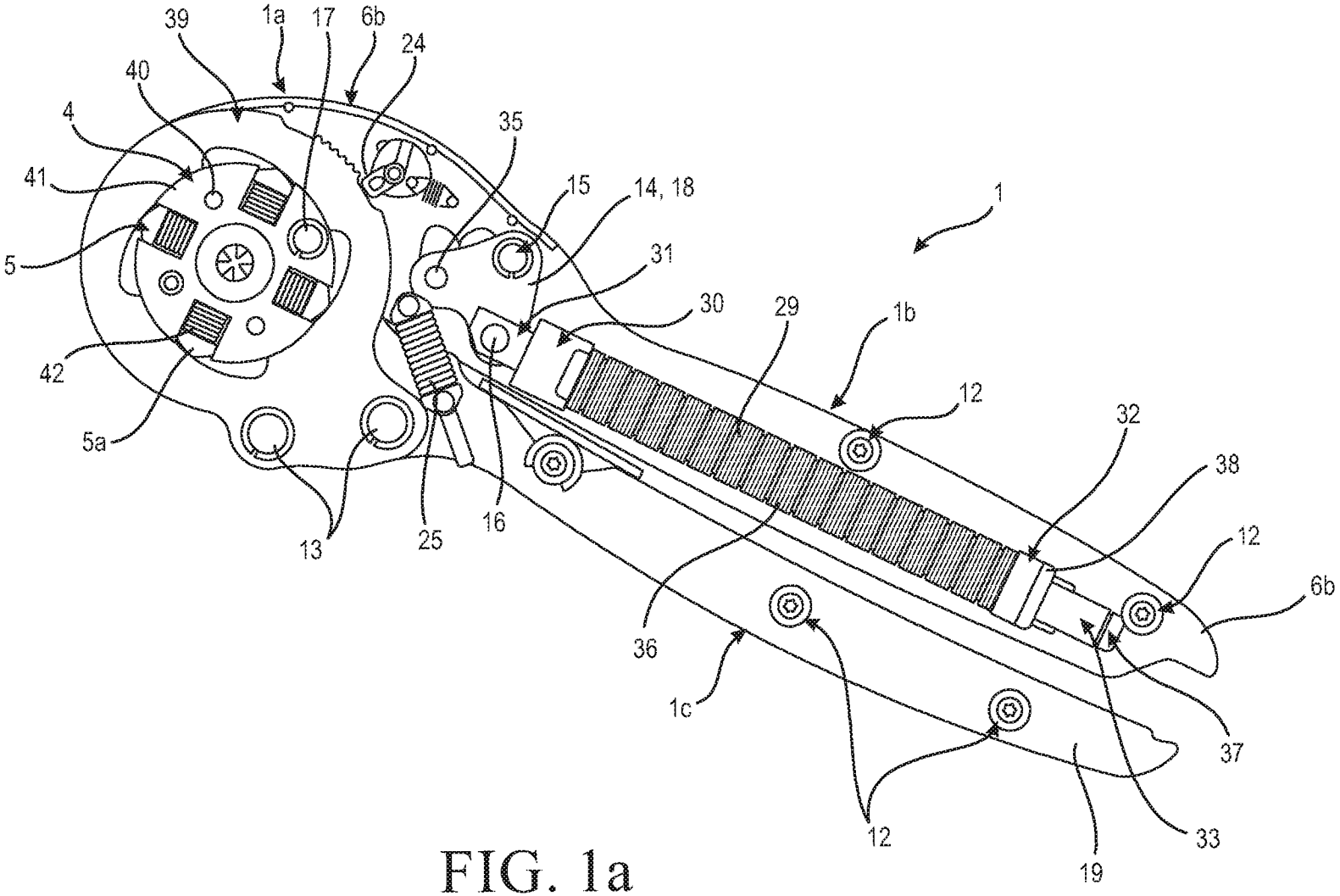
FIGS. 1*a* and 1*c* are left side elevation and top plan views, respectively, of the crimping tool of the present invention when in the closed condition, certain parts being removed for purpose of illustration.
Figure 8A:
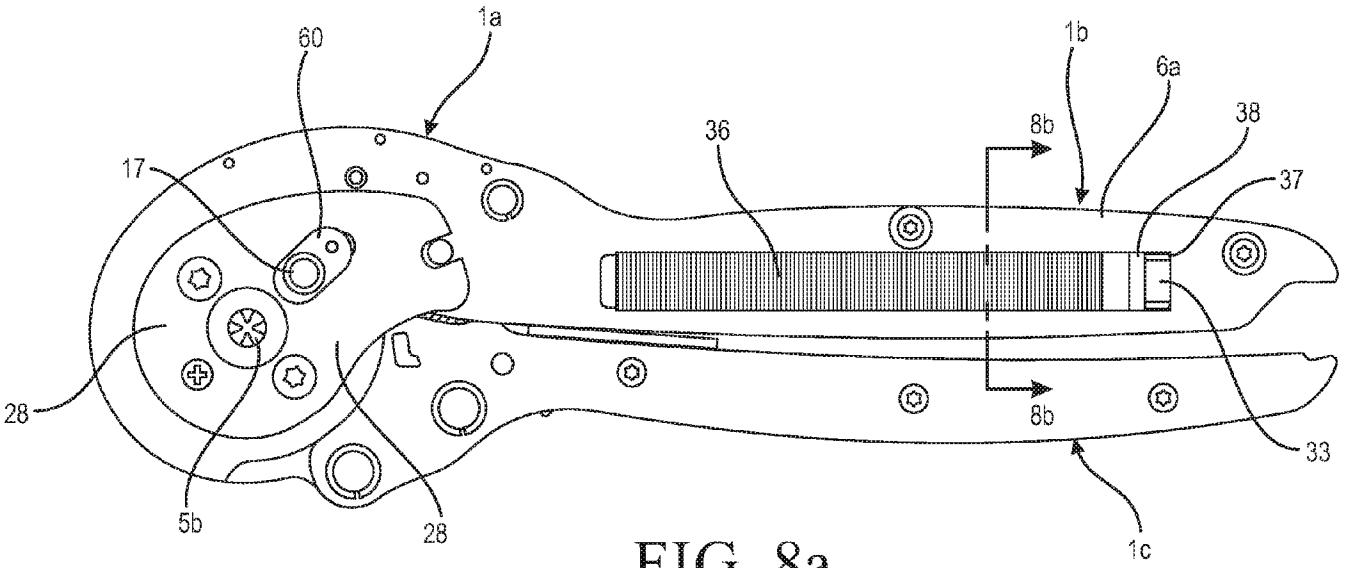
Figure 8B:
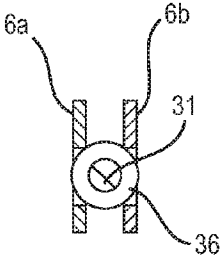
FIG. 8*b* is a sectional view taken along line 8*b*-8*b* of FIG. 8*a;*

Briefly, with reference first more particularly to FIG. 1*a*, the crimping tool 1 of the present invention includes a tool head portion 1*a* that is integral with a fixed lever 1*b*, and is pivotally connected with a pivotal lever 1*c*. The fixed lever and the integral tool head portion include a pair of parallel spaced side plates 6*a*, 6*b* (FIG. 8*b*) that are fastened together on opposite sides of tubular spacer sleeves by bolts or rivets 12. Similarly, the pivotal lever 1*c* includes similar parallel spaced side plates that are bolted together by bolts or rivets 12 on opposite sides of tubular spacer sleeves.

Arranged between the tool head portions of the side plates 6*a*, 6*b* are crimping die means 4 including an annular crimping element holder 41 having central annular hub portions 41*a*. These hub portions extend axially outwardly from opposite sides of the crimping element holder into corresponding openings contained in the head portions of the side plates 6*a* and 6*b*, thereby permitting angular rotational adjustment of the holder member relative to the tool head portion 1*a*, as will be described in greater detail below. Similarly, the hub portions 41*a* extend through corresponding openings contained in the parallel spaced side wall plates 19 of the pivotal lever 1*c*, whereby the pivotal lever is connected for pivotal displacement relative to the fixed lever 1*b*.

The crimping element holder member 41 contains a plurality of radial through passages in which are slideably mounted a plurality of crimping elements 5 that are biased radially outwardly by compression springs 42, respectively. The remote outer ends of the crimping elements are formed as cam followers 5*a* (FIG. 4), and the adjacent inner ends of the crimping elements have crimping tip portions 5*b*. Mounted for angular rotational displacement about the crimping element holder 41 is and annular cam member 39 having an inner circumferential surface provided with arcuate cam surfaces arranged for engagement by the crimping element cam followers 5*a*, respectively. Therefore, upon rotation of the cam 39 in one direction relative to the crimping element holder, the crimping elements are displaced radially inwardly, and upon rotation of the cam in the opposite direction, the crimping are displace radially inwardly by the cam surfaces. The cam member 39 is bolted to the pivotal lever 1*c* by the bolts 13. The outer circumferential surface of the cam member 39 is provided with a set of ratchet teeth 23 that are arranged for engagement by a spring-biased pawl 25 that is connected with the tool fixed head portion 1*a*, thereby locking the cam member against displacement relative to the tool head portion and the fixed lever 1*b*.

Figure 1B:
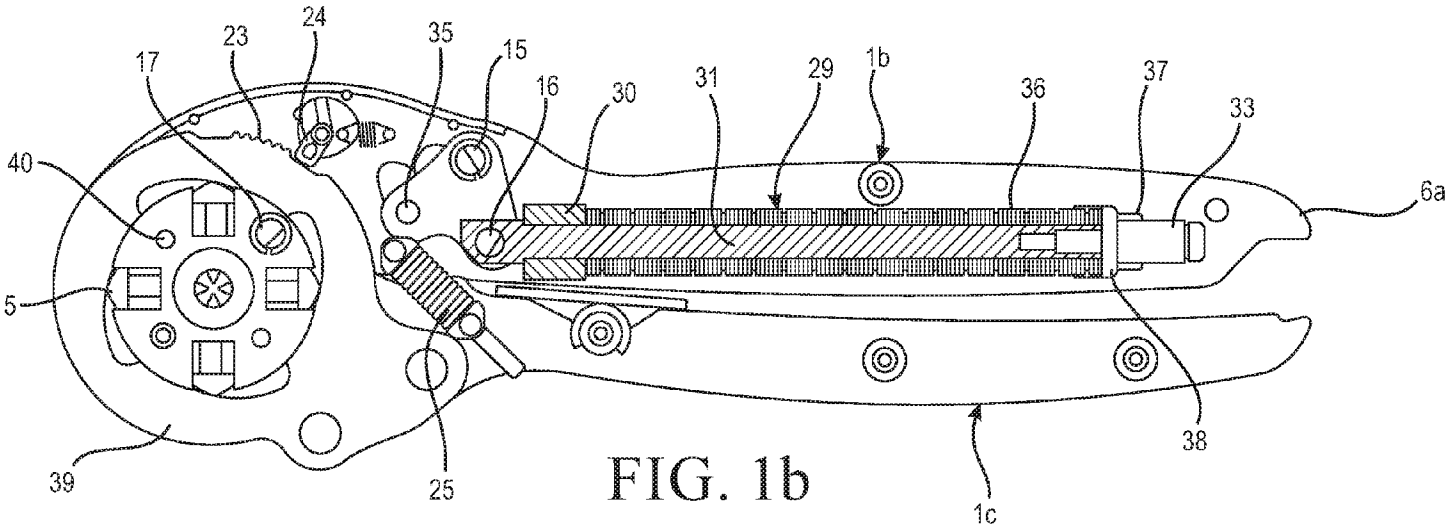
FIG. 1*b* is a sectional view taken along the line 1*b*-1*b* of FIG. 1*c;*
Figure 1C:
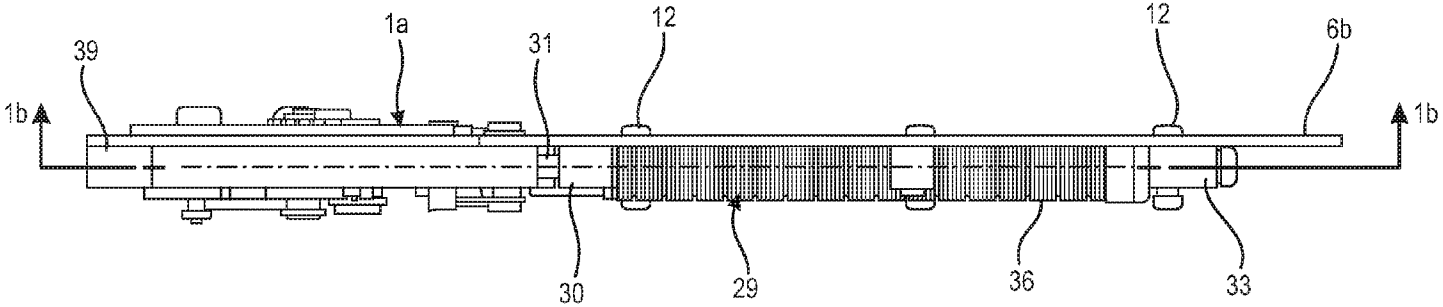

A spring assembly 29 is mounted longitudinally between the side plates 6*a* and 6*b* (FIG. 8*b*) of the fixed lever 1*b*, with opposed outer surfaces of the spring assembly extending into opposed windows 37 contained in the side plates 6*a* and 6*b*. At one end, the spring assembly abuts a fixed stop 30 fastened between the side plates 6*a* and 6*b*, and at the other end, the spring assembly abuts a tubular spacer sleeve 32 that is supported by a support washer 36 that in turn is supported by the opposed windows 37. A tie rod 31 (FIG. 1*b*) has a first end that extends longitudinally through the spring washer assembly 29 and through a bore contained in the fixed stop 30, said tie rod first end being pivotally connected by a second pivot pin 16 with a generally triangular operating lever 18, which operating lever has a first pivot pin 15 fastened to the fixed head portion 1*a* of the tool. The other end of the tie rod contains a threaded bore that is threadably connected with the shaft of an adjusting screw 33 that extends through the support washer 36, which adjusting screw has a head portion that abuts the support washer.

Figure 5:
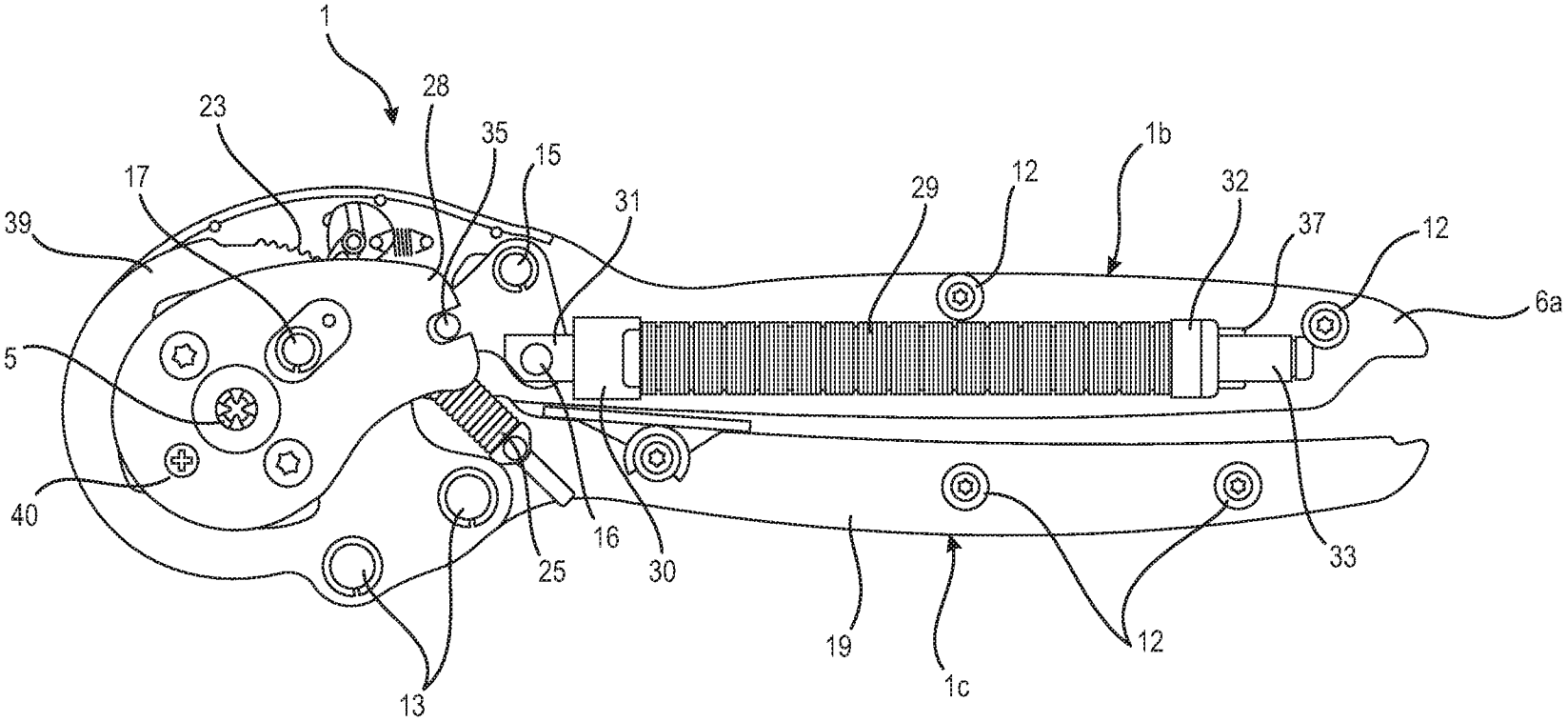
FIGS. 5 and 6 are left side elevation views, with certain parts removed, of the apparatus of FIG. 1*a*, with the compensation spring arrangement in the caged and uncaged conditions, respectively.

The operating lever 18 has a first leg defined between the pivot pins 15 and 16, and a second leg defined between pivot pin 16 and sliding pin 35 that extends into a slot contained in one end of a compensation lever 28 (FIG. 5). Pin 16 and sliding bolt 35 define a third lever leg. The other end of the compensation lever contains an opening that receives the associated hub portion 41*a* of the crimping element holder 41. The compensation lever 28 is bolted by bolts 40 to the crimping element holder 41. As will be described below in greater detail with respect to FIG. 9, the bolt 17 is an eccentric calibration bolt contained in slot 60 for initially calibrating the tool in the manufacturing facility.

What is understood by the term "wire end ferrules", in terms of the present invention, are crimp contacts in the form of sheaths, which are specified and designed to be pressed with a crimping motion onto the ends of flexible cables. A pressed or "compressed" wire end ferrule can, for example—this is not mandatory, however—be designed in the form of a trapezoid, hexagon or rectangle. To be understood additionally by the term "twisted contact" 2, in terms of the present invention, are such crimp contacts in the form of sheaths or wire end ferrules which are configured as twisted parts and which are likewise specified and designed to be applied in a crimping motion onto flexible cables, especially multi-wire cable ends. A pressed twisted contact 2 can especially be designed as a triple or n-point crimp.

Figure 10:
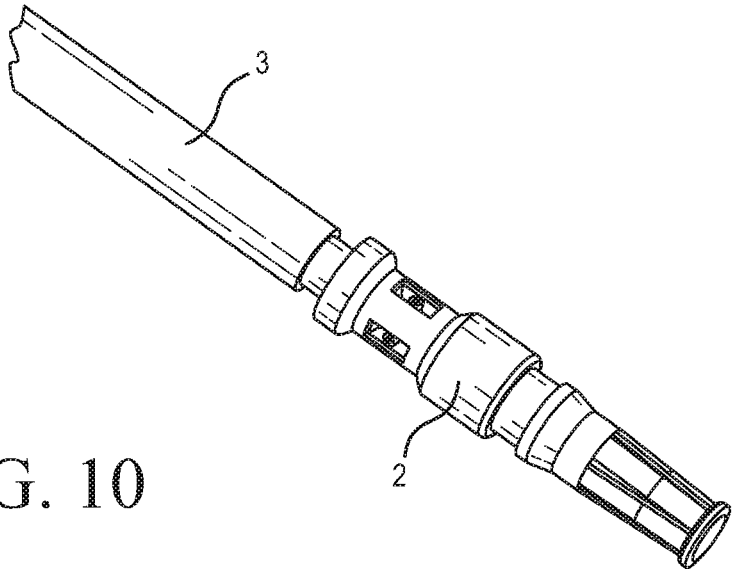
FIG. 10 is a perspective view illustrating the manner in which a female electrical contact is crimped onto the bare end of an insulated conductor.

Purely as an example, in FIG. 1*a*, a crimping tool 1 is shown for crimping of twisted contacts onto the ends of electrical cables (see FIG. 10). More particularly, the crimping tool 1 is here configured with manually operated crimping handles. It exhibits a tool head 1*a* and two manual handles 1*b* and 1*c* that move relative to each other, of which the one handle grip 1*c* is hinged so as to pivot on tool head 1*a*, and of which the other handle grip 1*b* is connected with tool head 1*a* so as not to pivot.

The tool head or the crimping tool 1 additionally exhibits two base plates 6*a, b* situated parallel to each other (of these, in FIG. 1*a*, only one is shown, and the handle is depicted with one base plate 1*a* removed; also see FIGS. 2 and 8), between and on which essential mechanical components are arranged and installed. The two base plates 6*a* and 6*b* are configured parallel to each other in the area of the tool head 1*a*, and extend from it through the manual grip 1*b* into the end area of manual grip 1*b* that integral with the tool head 1*a*. The two base plates 6*a*, 6 *b* are bolted together by connecting bolts 12 on opposite sides of spacer sleeves.

In each case one of the two base plates 6*a*, in the area of the tool head 1*a*, exhibits a central window- or aperture-type opening 7. At the opening—here centrally located to opening 7, between the base plates 6*a*, 6*b*—is a crimping station with a crimping die 4 with a placement that automatically adjusts, or self-adjusts, to the crimped sheath and cable cross-section to be processed.

The crimping die means 4 includes an annular cam member 39, which is situated between the two base plates 6*a*, 6*b*, coaxial to the circular opening 7 (not shown here). In a central opening, the cam member 39 receives the crimping die means 4 formed from three or more crimping elements 5 and a crimping element holder 41. For this, each of the crimping elements 5 is placed and guided in the holder 41, here radial to opening 7 of the base plate and an opening of holder 41 of the crimping die 4 that is flush with it. The crimping element holder 41 is securely connected by a plurality of bolts 40 with the compensation lever 28.

Figure 2:
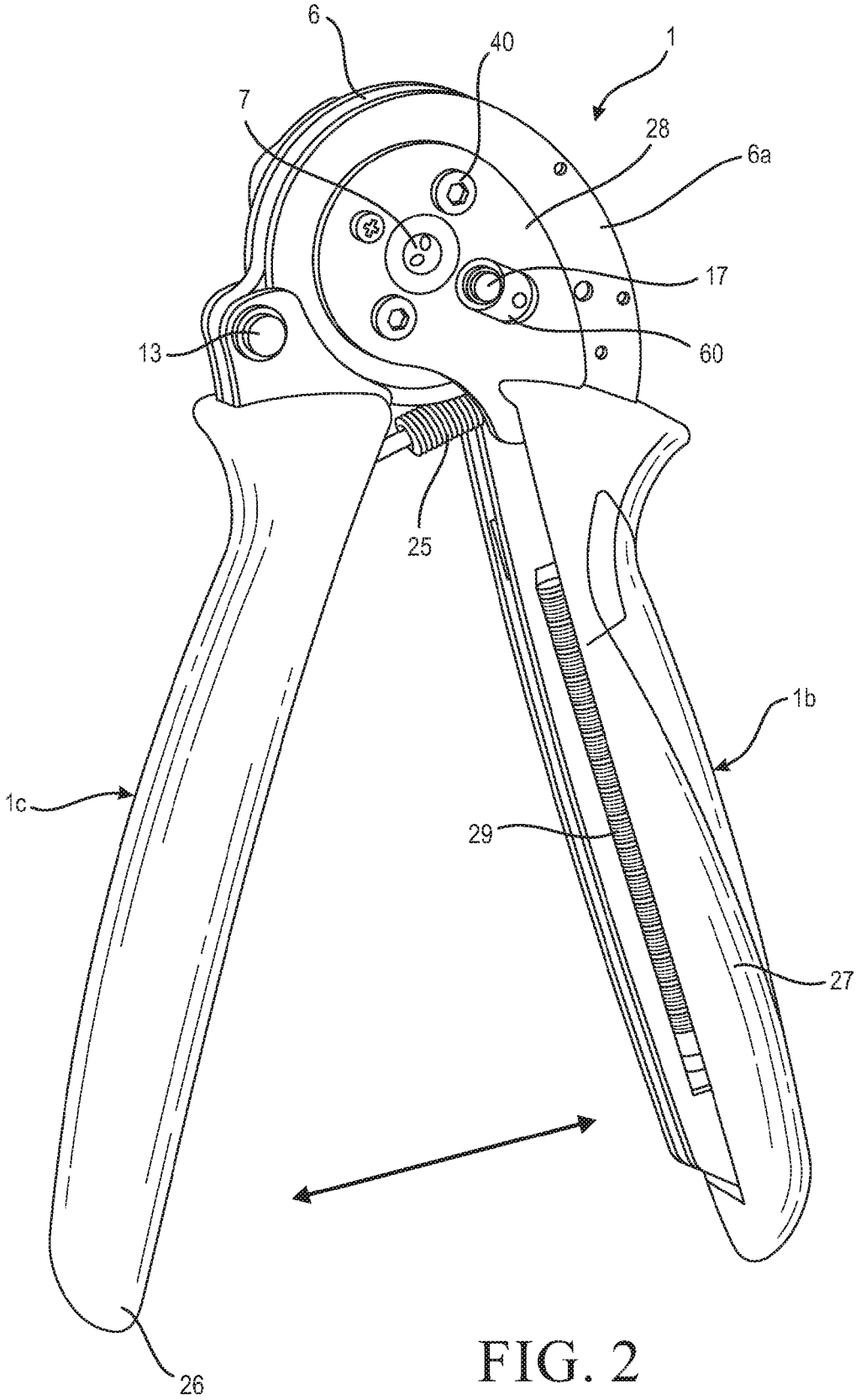
FIG. 2 is a left side elevation view, with certain parts removed, of the apparatus of FIG. 1*a* when in the fully open condition.

The annular cam member 39 is mounted on the crimping element holder 41 and can be rotatably angularly displaced around it. For this, the cam member 39 is connected via two bolts 13 with the pivotal lever 1*c* (which includes a pair of spaced parallel plates 19). The levers 19 are provided or sheathed with resilient insulating hand grip members 26 and 27 (FIG. 2). So that the crimping die means 4 is always safely operated up to an end stop, the cam member 39 is provided with a set of ratchet teeth 23 into which a pawl 24 on the base plate 6 or plates can mesh, thereby preventing the crimping die means 4 from being opened unintentionally and prematurely. A compression spring 25 between the movable lever and the fixed lever ensures independent opening of the crimping die 4 after crimping of the twisted contact 2 or the wire end ferrule 102.

FIG. 2 shows the crimping tool 1 in its opened setting. By manually bringing together the handles 1*b*, 1*c*, here equipped with hand grip members 26, 27, the twisted contact 2 is pressed or crimped onto the cable 3 (FIG. 10).

Figures 3, 4:
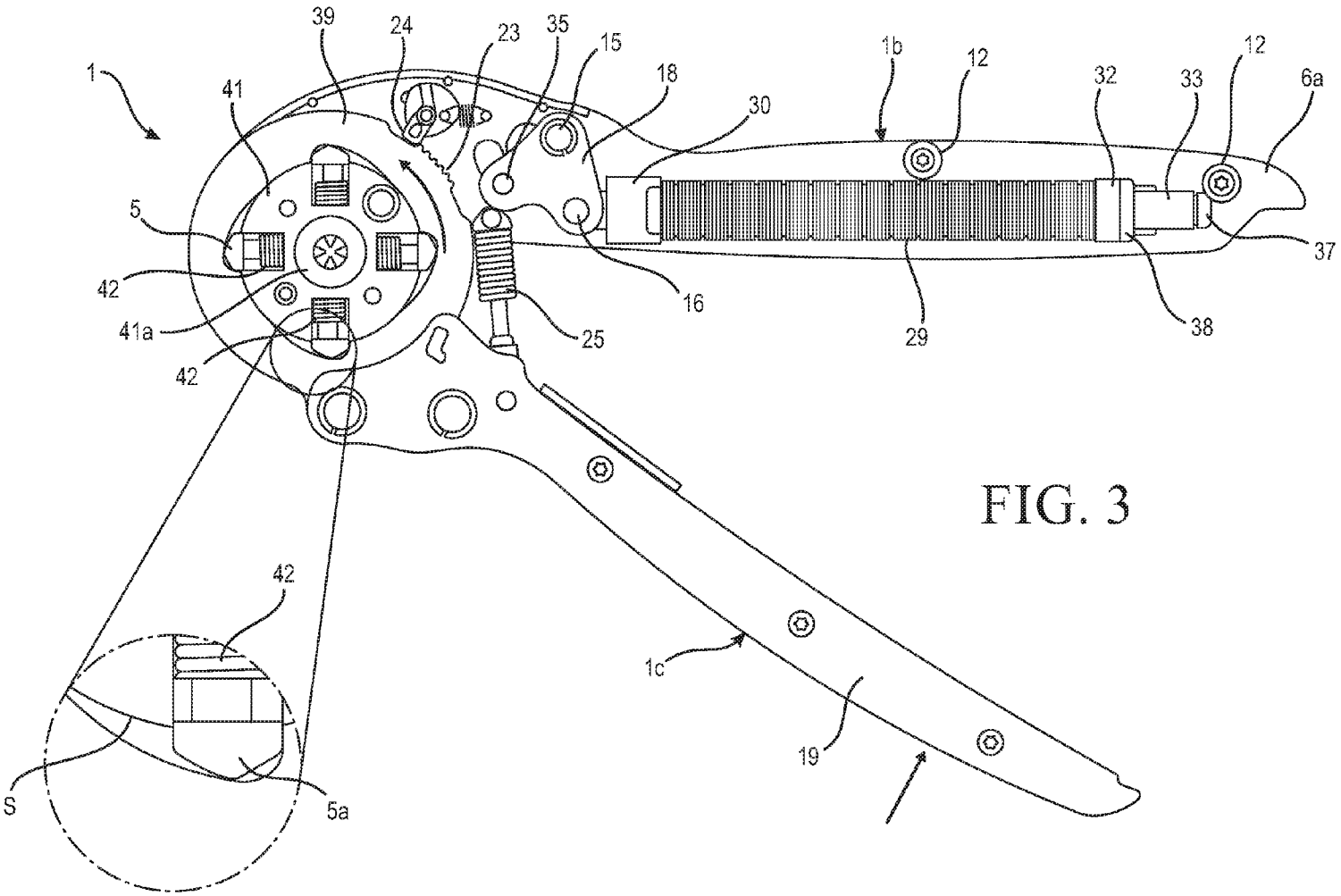
FIG. 3 is a left side elevation view, with various parts removed, of the apparatus of FIG. 1*a* when in the open condition.
FIG. 4 is a detailed view of the circled portion of FIG. 3.

In FIGS. 3 and 4, the mechanical drive of crimping tool 1 provided for this is disclosed in greater detail. By operating the pivotal lever 1*c*, the cam member 39 performs a turning motion on the outer circumference of crimping element holder 41. Via the contact in area S between cam member 39 and the crimping elements 5, cam member 39 glides along crimping holder 41 and displaces the crimping elements 5 radially inwardly toward engagement with the contact in the die opening 7.

To admit the crimping element holder 41 and crimping elements 5, the compression cam 39 contains an opening, the geometry of which is based on a circular borehole, which is expanded on the circumference with two or more arch-like cam surfaces, which, when the cam member 39 turns, touch the crimping follower portion 5*a* in a follower contact area, causing the crimping elements to move radially inwardly, thereby causing the crimping tips 5*b* to crimp the electrical contact. The contact area S in cam member 39 can be designed as a curve with a constant rise, or as a curve with a specially adjusted rise to optimized manual and compression forces. The crimping elements 5 are held or supported so as to move radially in the crimping stamp 41. The compression springs 42 bias the crimping elements 5, after the crimping operation, along curve S back toward their original positions.

In accordance with the present invention, to be able to process various contact and cable cross-sections by a single crimping die means 4, a force-path-compensation device is provided. This is simply designed as a spring assembly made of one, two or more springs, here by a spring washer assembly 29 made of axially-stacked spring washers 36. Here the spring washer assembly 29 is configured as an axial stacking of axially stacked spring washers 36, on, or even in, the fixed handle part 1*b*. Preferably, the spring washer assembly 29 is situated advantageously and in compact fashion between the two base plates 6*a* and 6*b*, extending in essence parallel to lever 1*b* in the handle grip, and only its outer circumferential sections projecting into the longitudinal windows or apertures 37 in the base plates 6*a*, 6*b* (see especially FIG. 8*b*). If a grip handle 226, 27 (FIG. 2) is placed on the sections of the base plate 6*a*, 6*b* in the area of the fixed lever 1*b*, the spring washer assembly can be virtually entirely covered, due to the skillful arrangement.

In order to mount the spring washer assembly 29 with ease, and to couple it with a deflection mechanism, a tie rod 31 is provided which axially penetrates the spring washer assembly and its spring washers 36. The spring washer assembly 29 and its spring washers 36 are placed between a split sleeve 33 on the one end of the tie rod (toward the free end of the handle grip 1*b*) and a spring stop 30 on the other end of the tie rod 21 (toward the tool head 1*a*).

The spring stop 30 supports the tie rod 31 and limits the displacement path of the spring washers, by being braced on the base plates 6*a*, 6*b* as a support. Attached axially to the spring stop 30, the spring washers 36 are lined up on the tie rod 31. On the opposite end of the tie rod 31, a device is provided, with which the pre-adjusted axial path of the tie rod, via which the spring washers 36 are lined up on the tie rod 31, can be moved, which also alters the pre-tensioning of the spring washer assembly 29 and makes possible an adjustment of this pre-tensioning. This movement and adjustment can be implemented in various ways. For example, an adjustable screw 33 can be inserted into a threaded bore in the tie rod 31 (FIG. 1*b*), so that the path between the spring stop 30 and the screw in the tie rod is adjustable. Alternatively, the thickness of a spacer sleeve 32 on this end of the tie rod 31 can be varied for adjustment, which is braced against a screw 33, which is inserted into the end of the tie rod 31 facing away from the spring stop 30. Also, other means of adjustment with screws, nuts and the like are conceivable. In this way, a desired functional connection between the closing dimension of the crimping elements 5 and the crimping force of the crimping elements 5 can be adjusted.

Operation

Figure 6:
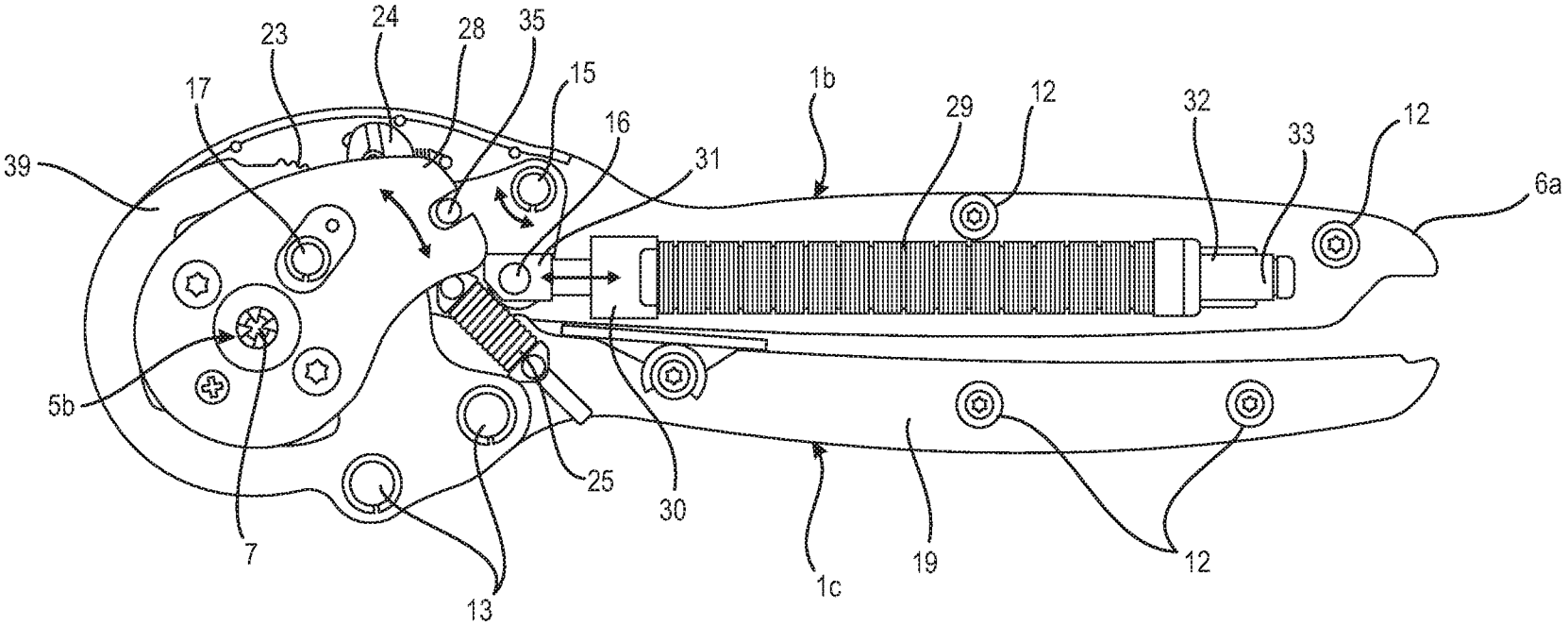

Assume that the crimping tool is in the open condition to FIGS. 2 and 3, and that the spring assembly 29 is in the caged-energy compressed condition. When the levers 1*b* and 1*c* are pivoted together to the closed condition of FIGS. 1*b* and 5, the cam 39 is rotated relative to the crimping element holder 41 to cause the crimping elements to be displaced radially inwardly, thereby to apply a first crimping force to a female contact arranged in the die opening 7. The cam 39 is then connected by the pawl 24 and ratchet 23 to the fixed head portion 1*a*, and as the levers continue to be manually squeezed together, the tie rod 31 becomes released, thereby permit expansion of the spring assembly 29 and the release of the caged energy of the spring assembly (FIG. 6). Operating lever 18 is pivoted in the clockwise direction, and pivot pin 35 pivots compensation lever 28 (and tool holder 41 connected thereto) in the counter-clockwise direction, whereby the crimping elements 5 of the tool holder 41 are further displace radially inwardly, thereby applying the caged energy as a second compensation crimping force to the female electrical contact in the crimping die means 4.

More particularly, if, during crimping, the crimping force defined for the inserted contact has been reached, the crimping element holder 41 moves uniformly with the cam 39 and further crimping of the contact is prevented. This is achieved by the holder 41 being supported so as to pivot in base plate 6. The crimping element holder 41 is connected securely (immovably) with adjustment compensation lever 28, which works in concert via deflection kinematics, here advantageously and by example consisting of a sliding bolt 35, which acts in concert with the compensation lever 28, an operating lever 18, a sliding bolt 16 and the tie rod 31, which pivots out the spring washer assembly 29, and thus implements the force-path-compensation of crimping elements 5, so that the crimping die means 4 automatically adjusts to the corresponding crimping cross-section (FIGS. 5 and 6). When extended out, the tie rod 31 is drawn by the holder 41 and the deflection kinematics in the direction of the tool head 1*a*, which compresses the spring washers 36 against the stop 30 that is fixed in place in the base plates 6*a*, 6*b*.

Use of the spring washer assembly 29 in the crimping tool 1 permits, via same-direction or opposite-direction layering (lining up of spring washers 36 or via a combination of these measures), with the spring washer of spring washer assembly 29 situated in groups or individually, to constitute spring characteristics of progressive, through linear, down to declining force-path behavior, thus optimally adapting the crimping outcome to the crimping cross-sections to be processed, from the small to the large.

To offer a sufficiently large range of compensation, it is advantageous if a plurality of spring washers is provided in the spring washer assembly 29. The spring washers of the spring washer assembly can also form groups or subassemblies 29*a*, 29*b* (see also FIG. 11). Then several of the groups 29*a*, 29*b* then form, in their assembled state, the actual (overall) spring washer assembly of the crimping tool (see FIG. 1*b*). By means of the conical angle of the spring washers, a desired force distribution, and, by means of the number of spring washers of the spring washer assembly 29 placed on one another, a desired path distribution, can be attained.

Figure 11:
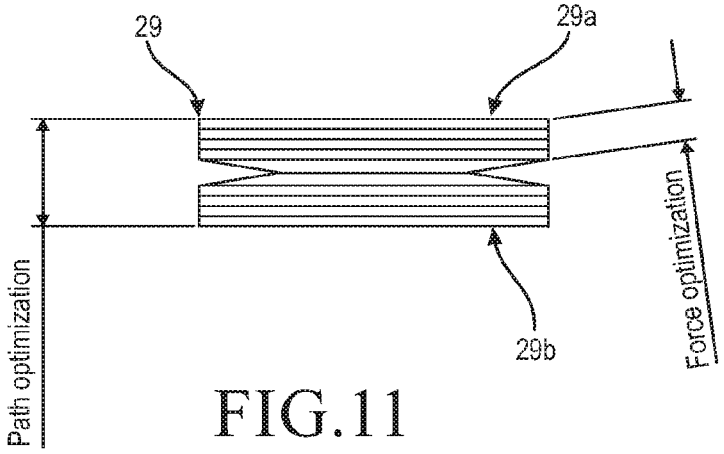
FIG. 11 illustrates a set of spring washer embodiment as used in a spring assembly.

The groups 29*a*, 29*b* of FIG. 11 each consists of some spring washers, which preferably are each configured as conical spring washers with perforations. It is advantageous if the groups 29*a*, 29*b* are each oriented opposite, so that each two of the groups 29*a*, 29*b* abut on each other in the area of the particular smallest outer diameter (so-to-speak, at the tip of the conical spring washers). Then, in the spring washer assembly 29, preferably several of these groups are attached to the dual grouping of FIG. 11 in the tool (see FIG. 1*b*). This arrangement has proven itself to be especially effective in terms of the invention-specific results.

FIG. 6 shows how the spring washer assembly 29 admits the required residual stroke of the crimping die 4 as elastic deformation work, if the crimping die 4, when crimping a twisted contact 2, or when crimping a wire end ferrule 102, has already reached the hard stop, but there is still a segment to be traversed so that the locking pawl 24 can release the opening of the crimping die 4. In this way the crimping tool 1 automatically adjusts to the cross section of the twisted contact 2 or of the wire end ferrule 2 to be crimped, and the cable cross section. By this means it is possible, with only one crimping die 4, in step-free fashion to cover the crimping of cable cross-sections from, for example, 0.08 $mm^2$ up to 6.0 $mm^2$ The crimping tool 1 can be closed until the pawl skips over the ratchet 23, and opens by itself, thereby compressing and transferring caged energy to the spring assembly.

Integration of the spring washer assembly 29 into the fixed lever base plate assembly 6 makes it possible to design the crimping tool 1 in compact fashion, while at the same time making a precise adjustment to the required force-path compensation. In comparison to other designs, less space is required, with identical performance. In addition, in advantageous fashion, the configuration is simplified, as is the dimensioning of the springs for the force-path compensation of crimping tool 1.

Figure 7:
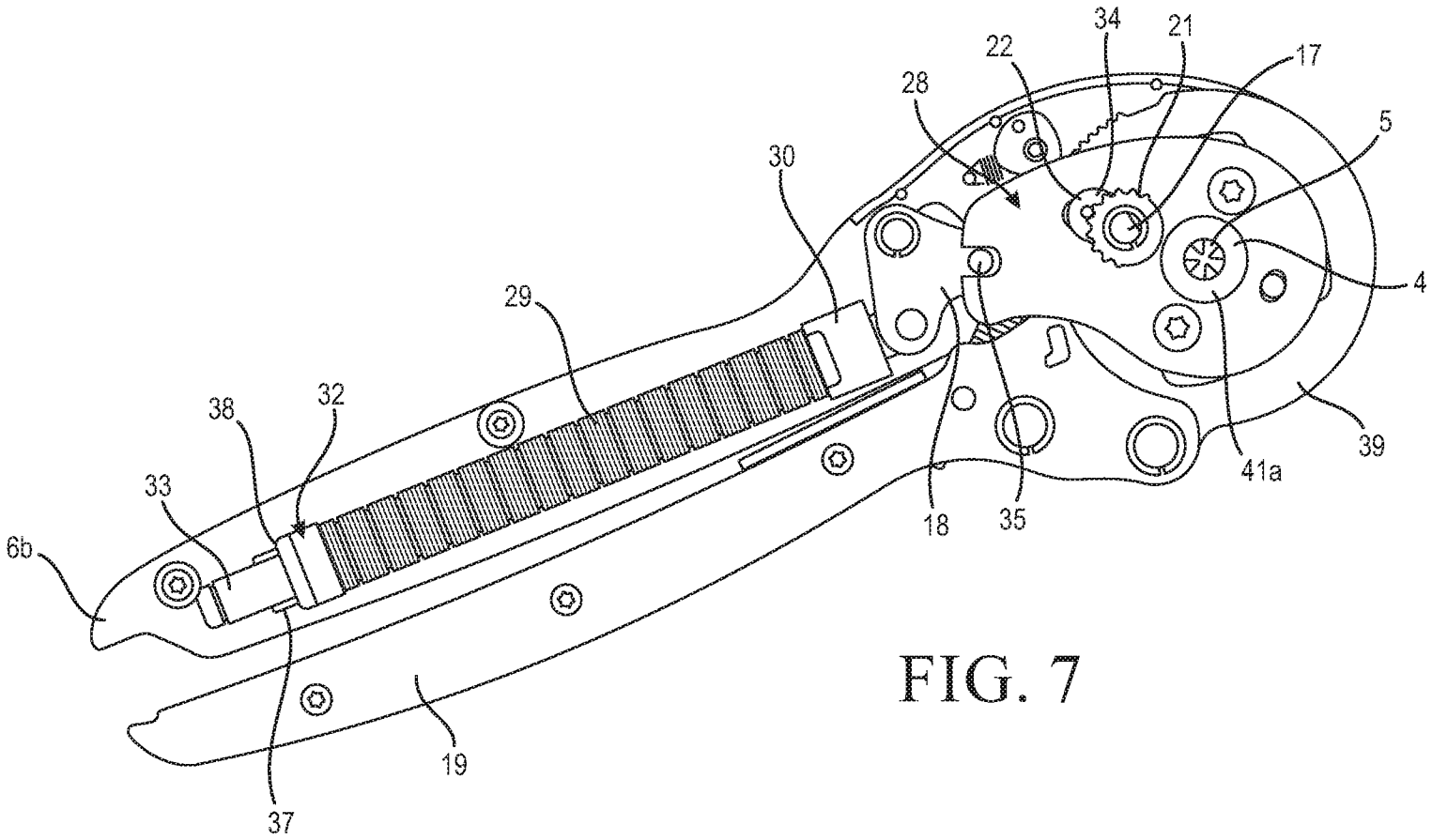
FIGS. 7 and 8*a* are right side and left side elevation views, respectively, of the apparatus of FIG. 5.

Referring now to FIG. 7, it is shown how, through the rotation of an eccentric bolt 17, the angular position of the punch holder 41 and of the compensating lever 28 can be altered relative to each other, by which the degree of closure of the crimping punch 5 can be adjusted. An adjusting washer 21 and a pan-head screw 22 secure the eccentric bolt 17 in the adjusted position. In this, the eccentric bolt 17 serves merely for the basic adjustment and if necessary compensation for manufacturing tolerances. Customarily, the eccentric bolt 17 is not adjusted by the user of crimping tool 1.

Figure 9:
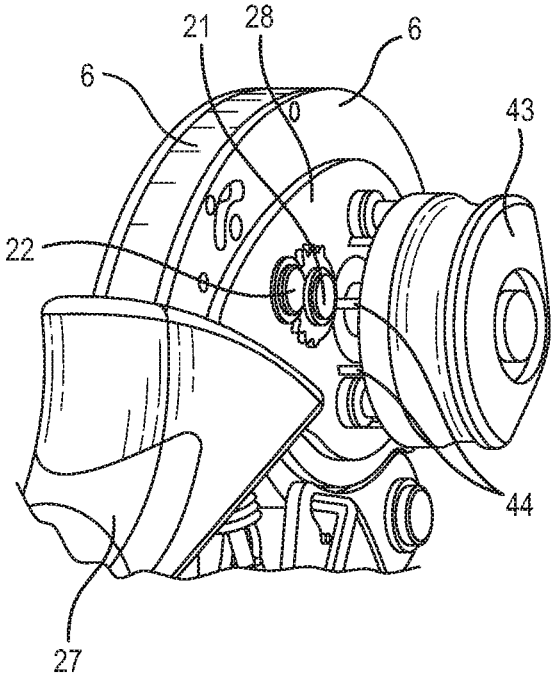
FIG. 9 is a detailed perspective view of the contact locator attachment for the crimping tool of FIG. 7.

FIG. 9 depicts an invention-specific crimping tool 1 with a locator 43 for twisted contacts 2. The locator 43 is adjusted to the type of contact to be processed, and locks in via a gear arrangement 44 on the tool head 1*a* in the adjusted position. The electrical contact 2 (not shown) is inserted into the opened crimping die 4 and held by the locator 43 in the crimping position. Thus the handling and crimping occur safely in process terms at the provided location on contact 2. By operating the handle 26 or 19 of the tool 1, the contact 2 is crimped onto the cable 3 (not shown).

FIG. 10 shows a cable 3, on the insulated end of which—purely as an example—a twisted contact 2 was compressed. In the depicted example, the twisted contact 2 was pressed with a four-point crimp.

Figure 12:
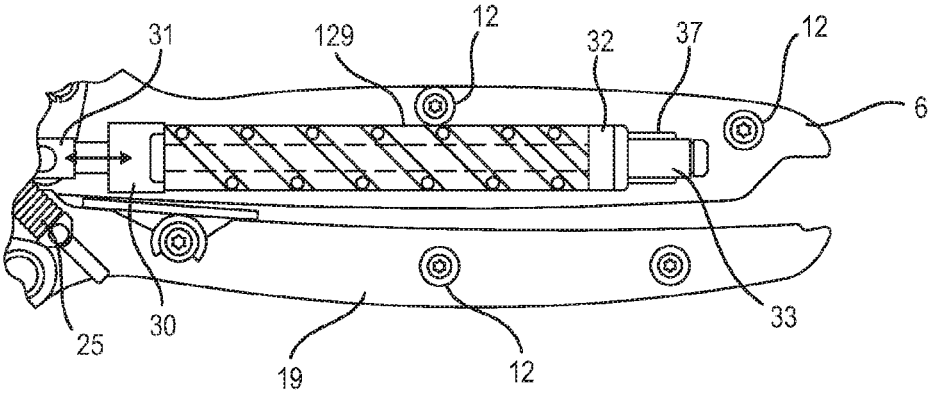
FIGS. 12 and 13 are detailed sectional views illustrating helical spring and resilient elastomer embodiments of the invention, respectively.
Figure 13:
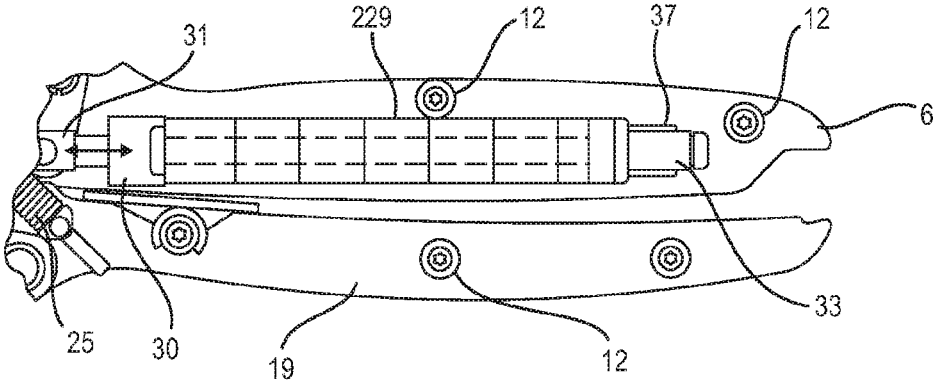

FIGS. 12 and 13 illustrate spring assemblies 129 and 229 of the types including helical springs and resilient elastomer units, respectively.

While in accordance with the provisions of the Patent Statutes the preferred forms and embodiments of the invention have been illustrated and described, it will be apparent to those skilled in the art that changes may be made without deviating from the invention described above.

What is claimed is:

1. A self-adjusting crimping tool for crimping a female electrical contact to the bare end of an insulated conductor, comprising:

(a) a pliers-type tool including a tool head portion, a fixed lever integral with said head portion, and a pivotal lever pivotally connected with said head portion for displacement between open and closed positions relative to said fixed lever;

(b) a crimping die mounted on said tool head portion for crimping the electrical contact to the bare conductor end, said crimping die being manually-operable to apply a first crimping force to the electrical contact upon initial displacement of said pivotal lever from said open position toward said closed position;

(c) a spring assembly including a compression spring mounted in one of said pivotal and fixed levers and a tie rod extending through a longitudinal through bore contained in said spring assembly, said tie rod having remote end portions connected with said tool such that said spring assembly is compressed when said pivotal lever is pivoted from said closed position to said open position, said spring assembly being operable from a force-caged condition to a force-released condition to subsequently operate said crimping die to apply a second crimping force to the contact; and (d) a return spring biasing said pivotal lever toward said open position.

2. A self-adjusting crimping tool as defined in claim 1, wherein said compression spring is mounted in said fixed lever; and further wherein said fixed lever comprises a pair of parallel spaced plates arranged on opposite sides of said spring assembly, said lever plates containing opposed elongated window openings partially receiving said spring assembly, respectively.

3. A self-adjusting crimping tool as defined in claim 2, and further including a stop block secured to said fixed lever, said stop block containing a through bore in which one end of said tie rod is slideably supported, said spring assembly having a first end in engagement with said stop block.

4. A self-adjusting crimping tool as defined in claim 3, and further including an annular stop washer mounted on said tie rod and extending partially into said window openings, said spring assembly having a second end in engagement with said stop washer.

5. A self-adjusting crimping tool as defined in claim 1, wherein said crimping die comprises:

(1) an annular crimping element holder having a side wall mounted on said tool body portion opposite an opening contained therein, said crimping element holder containing a central die opening, and a plurality of radial through passages extending radially outwardly from said central die opening;

(2) a plurality of crimping die elements slideably mounted in said radial passages, respectively, said die elements having adjacent ends in the form of crimping tips, and remote ends in the form of cam followers;

(3) an annular cam member mounted for rotation about said crimping element holder, said cam member having an inner circumferential surface provided with a plurality of cam surfaces; and (4) a plurality of die element biasing springs biasing said crimping elements radially outwardly relative to said crimping element holder, said crimping element holder being rotatable between a crimping position in which the cam surfaces on the inner circumferential surface of the crimping element holder cause the crimping elements to be displaced radially inwardly, thereby to crimp a contact positioned in said die opening, and a released position in which the crimping elements are displaced radially outwardly, thereby to open the die opening.

6. A self-adjusting crimping tool as defined in claim 5, and further including a latch for releasably locking said cam member to said fixed lever when said lever is in an intermediate position between said closed and open positions; and further wherein said spring assembly includes:

(1) a compensation lever having a first end pivotally connected with said tool head portion, said first end also being non-rotatably fastened in side-by-side relation to said crimping element holder, said compensation lever having a second end;

(2) an operating lever pivotally connected with said fixed lever by a first pivot pin, said operating lever having a first leg pivotally connected with the extremity of said tie rod first end by a second pivot pin, and a second leg pivotally connected with said compensation lever second end by a third pivot pin;

(3) said spring assembly being operable from a caged condition to a released uncaged condition when the crimping force defined for the inserted contact has been reached, thereby to release said tie rod to pivot said operating lever and said compensation lever in a direction causing angular rotation of said crimping element holder relative to said cam member, whereby said crimping elements are displaced radially inwardly relative to said crimping element holder member.

7. A self-adjusting crimping tool as defined in claim 6, and further including a calibration device adjusting the angular position of said compensation lever relative to said crimping element holder, thereby to vary the degree of closure of said crimping die to compensate for manufacturing tolerances.

8. A self-adjusting crimping tool as defined in claim 6, and further including a locator device operable to support an electrical contact within said die opening.

9. A self-adjusting crimping tool as defined in claim 1, wherein said spring assembly comprises at least one stack of spring washers arranged concentrically about said tie rod.

10. A self-adjusting crimping tool as defined in claim 1, wherein said spring assembly comprises at least one helical compression spring arranged concentrically about said tie rod.

11. A self-adjusting crimping tool as defined in claim 1, wherein said spring assembly comprises a plurality of resilient elastomer members containing aligned openings receiving said tie rod.

12. A self-adjusting crimping tool as defined in claim 1, wherein said spring assembly has a spring characteristic selected from the group consisting of a progressive spring characteristic curve, a linear spring characteristic curve, and a declining spring characteristic curve.

13. A self-adjusting crimping tool as defined in claim 5, wherein said crimping element holder includes annular outwardly-extending hub portions extending from each side thereof, said fixed and said pivotal lever each including a pair of parallel side plates containing opposed openings receiving said crimp element holder member hub portions, thereby to connect said pivotal lever for pivotal movement about said hub portions.

14. A self-adjusting crimping tool as defined in claim 6, wherein said latch comprises a pawl connected with said fixed lever, and a ratchet connected with said cam member, said pawl and said ratchet being operable to lock said cam member to said fixed lever when said pivotal lever is in an intermediate position between said open and closed positions, thereby to prevent premature opening of the crimping die.

15. A self-adjusting crimping tool as defined in claim 2, and further including hand grip members formed of resilient insulating material mounted on said fixed and pivotal levers, respectively.

* * * * *